US007713362B2

(12) United States Patent
Beguinot et al.

(10) Patent No.: US 7,713,362 B2
(45) **Date of Patent: *May 11, 2010**

(54) METHOD FOR MAKING AN ABRASION RESISTANT STEEL PLATE AND PLATE OBTAINED

(75) Inventors: Jean Beguinot, Le Creusot (FR); Jean-Georges Brisson, Le Creusot (FR)

(73) Assignee: Industeel Creusot, Puteaux (FR)

( * ) Notice: Subject to any disclaimer, the term of this patent is extended or adjusted under 35 U.S.C. 154(b) by 1117 days.

This patent is subject to a terminal disclaimer.

(21) Appl. No.: 10/535,305

(22) PCT Filed: Nov. 13, 2003

(86) PCT No.: PCT/FR03/03358

§ 371 (c)(1),
(2), (4) Date: Feb. 8, 2006

(87) PCT Pub. No.: WO2004/048619

PCT Pub. Date: Jun. 10, 2004

(65) Prior Publication Data

US 2006/0162826 A1 Jul. 27, 2006

(30) Foreign Application Priority Data

Nov. 19, 2002 (FR) ..... 02 14426

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 45/10*** | (2006.01) |

(52) U.S. Cl. ..... 148/664; 148/547; 148/548; 148/654; 148/660; 148/661; 148/320; 148/330

(58) Field of Classification Search ..... 148/664, 148/547, 548, 654, 660–661, 333–336, 320, 148/330; 420/104–114, 119–126

See application file for complete search history.

(56) References Cited

U.S. PATENT DOCUMENTS

| | | | | |
|---|---|---|---|---|
| 3,883,347 | A * | 5/1975 | Takashima | 75/567 |
| 4,170,497 | A | 10/1979 | Rao et al. | |
| 5,595,614 | A | 1/1997 | McVicker | |
| 5,714,116 | A * | 2/1998 | Beguinot et al. | 420/105 |
| 7,459,041 | B2 * | 12/2008 | Beguinot et al. | 148/664 |
| 7,462,251 | B2 * | 12/2008 | Beguinot et al. | 148/664 |

FOREIGN PATENT DOCUMENTS

| | | | |
|---|---|---|---|
| EP | 0 527 276 | A1 | 2/1993 |
| EP | 0 739 993 | A1 | 10/1996 |
| JP | 9-249935 | A | 9/1997 |

OTHER PUBLICATIONS

ASM International, Materials Park, Ohio, ASM Handbook vol. 4: Heat Treating, "Tempering of Steel", pp. 121-123, Aug. 1991.*

* cited by examiner

*Primary Examiner*—Roy King
*Assistant Examiner*—Jessee R. Roe
(74) *Attorney, Agent, or Firm*—Sughrue Mion, PLLC

(57) ABSTRACT

A method for producing a plate of steel which is resistant to abrasion and whose chemical composition includes, by weight: $0.24\% \leqq C < 0.35\%$; $0\% \leqq Si \leqq 2\%$; $0\% \leqq Al \leqq 2\%$; $0.5\% \leqq Si+Al \leqq 2\%$; $0\% \leqq Mn \leqq 2.5\%$ $0\% \leqq Ni \leqq 5\%$; $0\% \leqq Cr \leqq < 5\%$ $0\% \leqq Mo \leqq 1\%$; $0\% \leqq W \leqq 2\%$; $0.1\% \leqq Mo+W/2 \leqq 1\%$; $0\% \leqq B \leqq 0.02\%$; $0\% \leqq Ti \leqq 1.1\%$; $0\% \leqq Zr \leqq 2.2\%$; $0.35\% < Ti+Zr/2 \leqq 1.1\%$; $0\% \leqq S \leqq 0.15\%$; $N < 0.03\%$, optionally up to 1.5% of copper; optionally at least one element selected from Nb, Ta and V at contents such that $Nb/2 + Ta/4 + V \leqq 0.5\%$; optionally at least one element selected from among Se, Te, Ca, Bi, Pb at contents which are less than or equal to 0.1%; and the balance being iron and impurities resulting from the production operation. The chemical composition further complying with the following relationships: $C^* = C - Ti/4 - Zr/8 + 7 \times N/8 \geqq 0.095\%$ and $1.05 \times Mn + 0.54 \times Ni + 0.50 \times Cr + 0.3 \times (Mo+W/2)^{1/2} + K > 1.8$ with: $K=0.5$ if $B \geqq 0.0005\%$ and $K=0$ if $B < 0.0005\%$.

11 Claims, No Drawings

METHOD FOR MAKING AN ABRASION RESISTANT STEEL PLATE AND PLATE OBTAINED

This is a 371 of International Application PCT/FR03/003358 filed on Nov. 13, 2003; the entire disclosure of the prior application is hereby incorporated by reference.

BACKGROUND OF THE INVENTION

The present invention relates to an abrasion-resistant steel and its production method.

Steels are known which have a high level of abrasion resistance and whose hardness is approximately 600 Brinell. These steels contain from 0.4% to 0.6% of carbon and from 0.5% to 3% of at least one alloy element, such as manganese, nickel, chromium and molybdenum and they are quenched in order to have a completely martensitic structure. However, these steels are very difficult to weld and cut. In order to overcome these disadvantages, it has been proposed, in particular in EP 0 739 993, that a less hard steel be used for the same purposes, the carbon content of which is approximately 0.27% and which has a quenched structure containing a large quantity of residual austenite. However, these steels are still difficult to cut or weld.

SUMMARY OF THE INVENTION

The object of the present invention is to overcome these disadvantages by providing an abrasion-resistant steel plate whose abrasion-resistance is comparable to that of the known steels but which is more suitable for welding and thermal cutting.

To this end, the invention relates to a method for producing a workpiece, and in particular a plate, of steel for abrasion whose chemical composition comprises, by weight:

$0.24\% \geqq C < 0.35\%$ $0\% \leqq Si \leqq 2\%$ $0\% \leqq Al \leqq 2\%$ $0.5\% \leqq Si+Al \leqq 2\%$ $0\% \leqq Mn \leqq 2.5\%$ $0\% \leqq Ni \leqq 5\%$ $0\% \leqq Cr \leqq 5\%$ $0\% \leqq Mo \leqq 1\%$ $0\% \leqq W \leqq 2\%$ $0.1\% \leqq Mo+W/2 \leqq 1\%$ $0\% \leqq Cu \leqq 1.5\%$ $0\% \leqq B \leqq 0.02\%$ $0\% \leqq Ti \leqq 1.1\%$ $0\% \leqq Zr \leqq 2.2\%$ $0.35\% < Ti+Zr/2 \leqq 1.1\%$ $0\% \leqq S \leqq 0.15\%$ $N \leqq 0.03\%$ optionally at least one element selected from Nb, Ta and V at contents such that $Nb/2+Ta/4+V \leqq 0.5\%$, optionally at least one element selected from Se, Te, Ca, Bi, Pb at contents which are less than or equal to 0.1%, the balance being iron and impurities resulting from the production operation, the chemical composition further complying with the following relationships:

$C^* = C - Ti/4 - Zr/8 + 7 \times N/8 \geqq 0.095\%$ and preferably $\geqq 0.12\%$ and:

$1.05 \times Mn + 0.54 \times Ni + 0.50 \times Cr + 0.3 \times (Mo+W/2)^{1/2} + K > 1.8$ or more advantageously 2 with: $K=0.5$ if $B \geqq 0.0005\%$ and $K=0$ if $B < 0.0005\%$.

According to the method, the workpiece or the plate is subjected to a thermal quenching processing operation which is carried out in the heat for forming in the hot state, such as rolling, or after austenitization by reheating in a furnace, which consists in:

cooling the plate at a mean cooling rate greater than 0.5° C./s between a temperature greater than $AC_3$ and a temperature of from $T=800-270 \times C^* - 90 \times Mn - 37 \times Ni - 70 \times Cr - 83 \times (Mo+W/2)$, to T-50° C., the temperature being expressed in ° C. and the contents of C*, Mn, Ni, Cr, Mo and W being expressed as % by weight, then cooling the plate at a mean core cooling rate $Vr < 1150 \times ep^{-1.7}$ (in ° C./s) and greater than 0.1° C./s between the temperature T and 100° C., ep being the thickness of the plate expressed in mm, and cooling the plate as far as ambient temperature, planishing optionally being carried out.

Quenching may optionally be followed by tempering at a temperature of less than 350° C. and preferably less than 250° C.

DESCRIPTION OF THE INVENTION

The invention also relates to a plate obtained in particular by this method, the steel having a martensitic or martensitic/bainitic structure, the structure containing from 5% to 20% of retained austenite, as well as carbides. The thickness of the plate may be from 2 mm to 150 mm and the flatness thereof is characterized by a deflection less than or equal to 12 mm/m, and preferably less than 5 mm/m.

The invention will now be described in greater detail, but in a non-limiting manner, and illustrated with reference to examples.

In order to produce a plate according to the invention, a steel is produced whose chemical composition comprises, in% by weight:

from 0.24% to 0.35% of carbon in order to allow the formation of a large quantity of carbides and to obtain a sufficient level of hardness whilst being sufficiently suitable for welding; the carbon content is preferably less than 0.325% and, more advantageously, less than 0.3%.

From 0% to 1.1% of titanium, from 0% to 2.2% of zirconium. The total Ti+Zr/2 must be greater than 0.35% and preferably greater than 0.4%, and, even more advantageously, greater than 0.5% in order to form a large quantity of coarse carbides. However, this total must remain less than 1.1% in order to preserve a sufficient quantity of carbon in solution in the matrix after the formation of the carbides. This total must preferably remain less than 1%, and more advantageously 0.9% and, even more advantageously, less than 0.7% if priority needs to be given to the toughness of the material. As a result, the titanium content must preferably remain less than 1%, and more advantageously less than 0.9% or less than 0.7%, and the zirconium content must preferably remain less than 2% and, more advantageously, less than 1.8%, or less than 1.4%.

From 0% (or trace levels) to 2% of silicon and from 0% (or trace levels) to 2% of aluminium, the total Si+Al being from 0.5% to 2% and preferably greater than 0.7%. These elements which are deoxidants, further have the effect of promoting the production of a metastable retained austenite which is heavily charged with carbon whose transformation into martensite is accompanied by a large expansion promoting the anchoring of the titanium or zirconium carbides.

From 0% (or trace levels) to 2% or even 2.5% of manganese, from 0% (or trace levels) to 4% or even 5% of nickel and from 0% (or trace levels) to 4% or even 5% of chromium in order to obtain an adequate level of quenchability and adjust the various mechanical characteristics or characteristics for use. Nickel in particular has an advantageous effect on the toughness, but that element is expensive. Chromium also forms fine carbides in martensite or bainite.

From 0% (or trace levels) to 1% of molybdenum and from 0% (or trace levels) to 2% of tungsten, the total Mo+W/2 being from 0.1% to 1%, and preferably remaining less than 0.8%, or more preferably, less than 0.6%. Those elements increase the quenchability and form, in martensite or bainite, fine hardening carbides, in particular by precipitation owing to auto-tempering during cooling. It is not necessary to exceed a content of 1% of molybdenum in order to obtain the desired effect in particular with regard to the precipitation of hardening carbides. Molybdenum may be completely or partially replaced with twice the weight of tungsten. Nevertheless, this substitution is not desirable in practice since it does not provide any advantage over molybdenum and is more expensive.

Optionally from 0% to 1.5% of copper. That element can bring about additional hardening without inhibiting the weldability. Above a level of 1.5%, it no longer has a significant effect, leads to hot-rolling difficulties and is unnecessarily expensive.

From 0% to 0.02% of boron. That element can be added optionally in order to increase the quenchability. In order to achieve this effect, the boron content must preferably be greater than 0.0005%, or more advantageously, 0.001% and does not need to exceed substantially 0.01%.

Up to 0.15% of sulphur. That element is a residual which is generally limited to 0.005% or less, but its content may be voluntarily increased in order to improve machinability. It should be noted that in the presence of sulphur, in order to prevent difficulties concerning transformation in the hot state, the content of manganese must be greater than seven times the content of sulphur.

Optionally at least one element selected from niobium, tantalum and vanadium, at contents such that Nb/2+Ta/4+V remains less than 0.5% in order to form relatively coarse carbides which improve the resistance to abrasion. However, the carbides formed by those elements are less effective than those formed by titanium or zirconium and, for that reason, they are optional and added in a limited quantity.

Optionally, one or more elements selected from selenium, tellurium, calcium, bismuth and lead at contents of less than 0.1% each. These elements are intended to improve the machinability. It should be noted that, when steel contains Se and/or Te, the content of manganese must be such, taking into consideration the content of sulphur, that manganese selenides or tellurides can form.

The balance being iron and impurities resulting from the production operation. The impurities include in particular nitrogen, whose content depends on the production method but generally does not exceed 0.03%. That element may react with titanium or zirconium in order to form nitrides which must not be too coarse in order not to inhibit the toughness. In order to prevent the formation of coarse nitrides, titanium and zirconium may be added to liquid steel in a very progressive manner, for example, by placing in contact with the oxidized liquid steel an oxidized phase, such as a slag charged with titanium or zirconium oxides, then deoxidizing the liquid steel in order to cause the titanium or zirconium to diffuse slowly from the oxidized phase to the liquid steel.

Furthermore, in order to obtain satisfactory properties, the contents of carbon, titanium, zirconium and nitrogen must be such that:

$$C-Ti/4-Zr/8+7\times N/8 \geqq 0.095\%.$$

The expression $C-Ti/4-Zr/8+7\times N/8=C^*$ represents the content of free carbon after precipitation of the titanium and zirconium carbides, taking into consideration the formation of titanium and zirconium nitrides. That free carbon content $C^*$ Must be greater than 0.095% and preferably ≧0.12% in order to have martensite having a minimum hardness. The lower this content, the better the suitability for welding and thermal cutting.

The chemical composition must further be selected so that the quenchability of the steel is sufficient, taking into consideration the thickness of the plate which it is desirable to produce. To this end, the chemical composition must comply with the relationship:

$$Tremp=1.05\times Mn+0.54\times Ni+0.50\times Cr+0.3\times(Mo+W/2)^{1/2}+K>1.8 \text{ or more advantageously } 2$$

with: K=0.5 if B≧0.001% and K=0 if B<0.001%.

Furthermore, and in order to obtain good abrasion resistance, the micrographic structure of the steel is constituted by martensite or bainite or an admixture of those two structures, and from 5% to 20% of retained austenite, that structure further comprising coarse titanium or zirconium carbides which are formed at high temperature, or niobium, tantalum or vanadium carbides. The inventors have established that the effectiveness of coarse carbides for improving abrasion resistance could be inhibited by the premature separation thereof and that this separation could be prevented by the presence of metastable austenite which is transformed under the effect of the abrasion phenomena. The transformation of the metastable austenite being brought about by expansion, that transformation in the abraded sub-layer increases the resistance to separation of the carbides and, in that manner, improves abrasion resistance.

Furthermore, the great hardness of the steel and the presence of embrittling titanium carbides make it necessary to limit insofar as possible the planishing operations. From that point of view, inventors have established that, by slowing down the cooling sufficiently in the range of bainitic/martensitic transformation, the residual deformations of the products are reduced, which allows planishing operations to be limited. The inventors established that, by cooling down the workpiece or the plate at a cooling rate $Vr<1150\times ep^{1.7}$, (in this formula, ep is the thickness of the plate expressed in mm, and the cooling rate is expressed in ° C./s) below a temperature $T=800-270\times C^*-90\times Mn-37\times Ni-70\times Cr-83\times(Mo+W/2)$, (expressed in ° C.), firstly, a significant proportion of residual austenite was produced and, secondly, the residual stresses brought about by the phase changes were reduced. This reduction of stresses is desirable, both for limiting the use of planishing or facilitating it on the one hand, and, on the other hand, for limiting the risks of cracking during subsequent welding and bending operations.

In order to produce a very planar plate which has good abrasion resistance, the steel is produced and is cast in the form of a slab or ingot. The slab or ingot is hot-rolled in order to obtain a plate which is subjected to thermal processing which allows both the desired structure and good surface evenness to be obtained without further planishing or with limited planishing. The thermal processing may be carried out directly in the rolling heat or carried out subsequently, optionally after cold-planishing or planishing at a medium temperature.

In order to carry out the thermal processing operation:

either directly after hot-rolling, or after heating above the point $AC_3$, the plate is cooled at a mean cooling rate greater than 0.5° C./s, that is to say, greater than the critical bainitic transformation velocity, as far as a temperature which is equal to or slightly less than a temperature $T=800-270\times C^*-90\times Mn-37\times Ni-70\times Cr-83\times(Mo+W/2)$, (expressed in ° C.) in order to prevent the formation of ferritic or perlitic constituents. Slightly lower is understood to be a temperature of from T to T-50° C., or more advantageously from T to T-25° C., or even more advantageously, from T to T-10° C., then, the plate is cooled, between the temperature defined above and approximately 100° C., at a mean core cooling rate Vr of from 0.1° C./s, in order to obtain sufficient hardness, to $1150\times ep^{-1.7}$ in order to obtain the desired structure, and the plate is cooled as far as ambient temperature preferably, but without being compulsory, at a slow rate.

Furthermore, it is possible to carry out a stress-relief processing operation, such as a tempering operation, at a temperature less than or equal to 350° C., and preferably less than 250° C.

In this manner, a plate is obtained whose thickness can be from 2 mm to 150 mm and which has excellent flatness, characterized by a deflection of less than 12 mm per metre without planishing or with moderate planishing. The plate has a hardness of approximately from 280 HB to 450 HB. That hardness-depends principally on the content of free carbon $C^*=C-Ti-/4-Zr/8+7\times N/8$.

By way of example, steel plates designated A and C according to the invention and D and E according to the prior art were produced. The chemical compositions of the steels, expressed in $10^{-3}$% by weight, as well as the hardness and a wear resistance index Rus, are summarized in Table 1.

The wear resistance is measured by the loss of weight of a prismatic test piece which-is rotated in a -container containing graded quartzite aggregate for a period of 5 hours.

The index Rus of a steel is equal to 100 times the ratio of the wear resistance of the steel in question and the wear resistance of a reference steel (steel D). A steel whose index Rus=110 thus has a wear resistance 10% greater than that of the reference steel.

All the plates have a thickness of 27 mm and are quenched after austenitization at 900° C.

After austenitization, for the plates of steel A and C, the mean cooling rate is 7° C./s above temperature T defined above and 1.6° C./s therebelow, in accordance with the invention;

for the plate B, the mean cooling rate is 0.8° C./s above temperature T defined above and 0.15° C./s therebelow, in accordance with the invention;

the plates of steel D and E, given by way of comparison, were cooled at a mean rate of 24° C./s above temperature T defined above and at a mean rate of 120° C./s therebelow.

TABLE 1

| | C | Si | Al | Mn | Ni | Cr | Mo | W | Ti | B | N | C* | HB | Rus |
|---|---|---|---|---|---|---|---|---|---|---|---|---|---|---|
| A | 245 | 820 | 40 | 1620 | 220 | 150 | 280 | — | 405 | 3 | 6 | 149 | 380 | 121 |
| B | 275 | 650 | 50 | 1210 | 210 | 1100 | 250 | — | 600 | 2 | 5 | 129 | 305 | 111 |
| C | 245 | 480 | 30 | 1340 | 300 | 710 | 100 | 200 | 360 | 2 | 5 | 159 | 385 | 114 |
| D | 290 | 810 | 60 | 1290 | 495 | 726 | 330 | — | — | 2 | 6 | 290 | 520 | 100 |
| E | 295 | 260 | 300 | 1330 | 300 | 710 | 340 | — | 100 | 2 | 5 | 274 | 525 | 103 |

The plates according to the invention have an auto-tempered martensitic/bainitic structure which contains from 5% to 20% of retained austenite and coarse titanium carbides, whilst the plates given by way of comparison have a completely martensitic structure.

Comparison of the wear resistances and the levels of hardness indicates that, though being very substantially less hard than the plates given by way of comparison, the plates according to the invention have a slightly better wear resistance. Comparison of the free carbons indicates that the high level of wear resistance of the plates according to the invention is produced with free carbons which are very substantially smaller, which leads to significantly improved suitability for welding or thermal cutting than is the case for the plates according to the prior art. Furthermore, the deformation after cooling, without planishing, for steels A to C according to the invention is approximately 5 mm/m and 16 mm/m for the steels D and E given by way of comparison. These results indicate the reduction of deformation of the products obtained owing to the invention.

The result in practice, in accordance with the extent of surface evenness required by the users, is:

either the products can be supplied without planishing which results in a saving in terms of costs and a reduction in residual stresses, or a planishing operation can be carried out in order to comply with stricter requirements in terms of surface evenness (for example, 5 mm/m), but more readily and with fewer stresses being introduced owing to the lesser original deformation of the products according to the invention.

The invention claimed is:

1. Method for producing a plate of steel which is resistant to abrasion and whose chemical composition comprises, by weight:

$$0.24\% \leqq C < 0.35\%$$

$$0\% \leqq Si \leqq 2\%$$

$$0\% \leqq Al \leqq 2\%$$

$$0.5\% \leqq Si+Al \leqq 2\%$$

$0\% \leqq Mn \leqq 2.5\%$ $0\% \leqq Ni \leqq 5\%$ $0\% \leqq Cr \leqq 5\%$ $0\% \leqq Mo \leqq 1\%$ $0\% \leqq W \leqq 2\%$ $0.1\% \leqq Mo+W/2 \leqq 1\%$ $0\% \leqq B \leqq 0.02\%$ $0\% \leqq Ti \leqq 1.1\%$ $0\% \leqq Zr \leqq 2.2\%$ $0.5\% < Ti+Zr/2 \leqq 1.1\%$ $0\% \leqq S \leqq 0.15\%$ $N < 0.03\%$ optionally up to 1.5% of copper, optionally at least one element selected from Nb, Ta and V at contents such that $Nb/2+Ta/4+V \leqq 0.5\%$, optionally at least one element selected from Se, Te, Ca, Bi, Pb at contents which are less than or equal to 0.1%, the balance being iron and impurities resulting from the production operation, the chemical composition further complying with the following relationships:

$$C^* = C - Ti/4 - Zr/8 + 7 \times N/8 \geqq 0.095\%$$

and:

$$1.05 \times Mn + 0.54 \times Ni + 0.50 \times Cr + 0.3 \times (Mo+W/2)^{1/2} + K > 1.8$$

with: $K=0.5$ if $B \geqq 0.0005\%$ and $K=0$ if $B < 0.0005\%$, according to which the plate is subjected to a thermal quenching processing operation which is carried out in the heat for rolling in the hot state or after austenitization by reheating in a furnace, in order to carry out the quenching:

the plate is cooled at a mean cooling rate greater than 0.5° C./s between a temperature greater than $AC_3$ and a temperature of from approximately $T=800-270 \times C^* - 90 \times Mn - 37 \times Ni - 70 \times Cr - 83 \times (Mo+W/2)$, to T-50° C., the plate is then cooled at a mean core cooling rate $Vr < 1150 \times ep^{-1.7}$ and greater than 0.1° C./s between the temperature T and 100° C., ep being the thickness of the plate expressed in mm, the plate is cooled as far as ambient temperature and optionally planishing is carried out.

2. Method according to claim 1, wherein:

$$1.05 \times Mn + 0.54 \times Ni + 0.50 \times Cr + 0.3 \times (Mo+W/2)^{1/2} + K > 2.$$

3. Method according to claim 1, wherein:

$$C^* \geqq 0.12\%.$$

4. Method according to claim 1, wherein:

$$Si+Al \geqq 0.7\%.$$

5. Method according to claim 1, wherein tempering is further carried out at a temperature which is less than or equal to 350° C.

6. Method according to claim 1, wherein, the chemical composition of steel is obtained by a melting process during which or after the steel is placed in contact with a slag containing titanium and the titanium of the slag is caused to diffuse in the steel which is in a liguid state.

7. A plate of steelwhich is resistant to abrasion and whose chemical composition comprises, by weight:

$0.24\% \leqq C < 0.35\%$ $0\% \leqq Si \leqq 2\%$ $0\% \leqq Al \leqq 2\%$ $0.5\% \leqq Si+Al \leqq 2\%$ $0\% \leqq Mn \leqq 2.5\%$ $0\% \leqq Ni \leqq 5\%$ $0\% \leqq Cr \leqq 5\%$ $0\% \leqq Mo \leqq 1\%$ $0\% \leqq W \leqq 2\%$ $0.1\% \leqq Mo+W/2 \leqq 1\%$ $0\% \leqq B \leqq 0.02\%$ $0\% \leqq Ti \leqq 1.1\%$ $0\% \leqq Zr \leqq 2.2\%$ $0.5\% < Ti+Zr/2 \leqq 1.1\%$ $0\% \leqq S \leqq 0.15\%$ $N < 0.03\%$ optionally up to 1.5% of copper, optionally at least one element selected from Nb, Ta and V at contents such that $Nb/2+Ta/4+V \leqq 0.5\%$, optionally at least one element selected from Se, Te, Ca, Bi, Pb at contents which are less than or equal to 0.1%, the balance being iron and impurities resulting from the production operation, the chemical composition further complying with the following relationships:

$$C^* = C - Ti/4 - Zr/8 + 7 \times N/8 \leqq 0.095\%$$

and:

$$1.05 \times Mn + 0.54 \times Ni + 0.50 \times Cr + 0.3 \times (Mo+W/2)^{1/2} + K > 1.8$$

with: $K=0.5$ if $B \geqq 0.0005\%$ and $K=0$ if $B < 0.0005\%$, the steel having a martensitic or martensitic/bainitic structure, the structure containing from 5% to 20% of retained austenite and carbides.

8. Workpiece according to claim 7, characterized in that:

$$1.05 \times Mn + 0.54 \times Ni + 0.50 \times Cr + 0.3 \times (Mo+W/2)^{1/2} + K > 2.$$

9. A plate according to claim 7, wherein:

$$C^* \geqq 0.12\%.$$

10. A plate according to claim 7, wherein:

$$Si+Al \geqq 0.7\%.$$

11. A plate according to claim 7, wherein the plate has a thickness of from 2 mm to 150 mm.

* * * * *